US005352377A

United States Patent [19]

Blain et al.

[11] Patent Number: 5,352,377

[45] Date of Patent: Oct. 4, 1994

[54] CARBOXYLIC ACID/ESTER PRODUCTS AS MULTIFUNCTIONAL ADDITIVES FOR LUBRICANTS

[75] Inventors: David A. Blain, Notre Dame de Gravenchon, France; Robert H. Davis, Pitman; Andrew G. Horodysky, Cherry Hill, both of N.J.; Shi-Ming Wu, Newtown, Pa.

[73] Assignee: Mobil Oil Corporation, Fairfax, Va.

[21] Appl. No.: 15,970

[22] Filed: Feb. 8, 1993

[51] Int. Cl.[5] ..... C10M 151/00

[52] U.S. Cl. ..... 252/51.5 R

[58] Field of Search ..... 252/51.5 R

[56] References Cited

U.S. PATENT DOCUMENTS 3,183,070 5/1965 Udelhofen ..... 44/391

*Primary Examiner*—John Niebling
*Assistant Examiner*—Edna Wong
*Attorney, Agent, or Firm*—Alexander J. McKillop; Malcolm D. Keen; Charles A. Malone

[57] ABSTRACT

Reaction products of hydrocarbylcarboxylic anhydrides and aminoalkanols can provide effective antiwear, antirust, and corrosion-inhibiting properties in lubricant and fuel applications.

17 Claims, No Drawings

CARBOXYLIC ACID/ESTER PRODUCTS AS MULTIFUNCTIONAL ADDITIVES FOR LUBRICANTS

BACKGROUND OF THE INVENTION

1. Field of the Invention

This application is directed to reaction products of hydrocarbylsuccinic anhydrides and aminoalkanols as effective multifunctional antiwear, antirust, corrosion inhibiting additives for lubricants and to lubricant compositions containing same.

2. Description of Related Art

Alkenylsuccinic anhydrides have been widely used in petroleum and synthetic lubricant products for their lubricity and solvency. Products made by reacting amines with alkyl or alkenylsuccinic anhydrides to form alkyl or alkenylsuccinimides are well known as detergents and dispersants for lubricants and fuels. Post-reaction of these succinimides to introduce other beneficial functional groups can be performed.

U.S. Pat. No. 4,519,929 (O'Brien et al.) is directed to a product made by grafting an N-alkyl amide to an olefin polymer having a molecular weight of about 500 to 500,000 which improves lubricant oil dispersancy.

U.S. Pat. No. 4,448,974 (O'Brien et al.) is directed to lubricant oil dispersants made by reacting an aldehyde with an amine and reacting the product thereof with a hydrocarbon-substituted succinic acid, anhydride or lower alkyl ester.

U.S. Pat. No. 4,295,983 (Papay et al.) is directed to improving engine fuel economy by adding a friction reducing amount of a borated N-hydroxymethyl aliphatic hydrocarbyl succinimide to the engine crankcase.

U.S. Pat. No. 4,016,092 is directed to reaction products made from alkylphenols, formaldehyde and tris(hydroxymethyl)aminomethane to yield a product which is further reacted with boric acid, dialkylphosphates or diarylphosphates, to provide derivatives useful as detergents in various organic media.

U.S. Pat. No. 4,097,389 is directed to reaction products of (a) alkenyl succinic anhydrides and aminoalcohols, such as tris(hydroxymethyl)aminomethane, and (b) boric acid or organoborates or (c) organophosphates and aldehydes. Further, this patent refers to an intermediate prepared from tris(hydroxymethyl)aminomethane which contains oxazoline components when the reaction is carried out at 175° C. or below. The final reaction products are described as being useful in lubricants, fuels or other industrial fluids as detergents.

U.S. Pat. No. 4,652,387 is directed to reaction products of (a) alkenyl succinic anhydrides, (b) diarylamines and (c) aminoalcohols which are described as being dispersants and antioxidant/anticorrosion additives.

In contradistinction, we have found that the reaction products of hydrocarbylsuccinic anhydrides and aminoalkanols have excellent rust/corrosion inhibiting and antiwear properties. These compounds represent a unique class of ashless, non-sulfur/phosphorus-containing yet surface-active multifunctional additives. The composition of matter, the lubricant compositions containing such additives, and the use of such reaction products in lubricants to improve the performance properties are all believed to be unique and novel.

BRIEF SUMMARY OF THE INVENTION

This application is more particularly directed to the reaction products provided when a hydrocarbylsuccinic anhydride or its acid equivalent is reacted with a suitable aminoalkanol. Reaction products of hydrocarbylsuccinic anhydrides and aminoalkanols exhibit excellent lubricating properties in addition to unexpected antiwear and rust/corrosion inhibiting characteristics. This application is also directed to lubricating compositions comprising such reaction products.

More specifically, this application is directed to lubricant compositions comprising a major amount of an oil of lubricating viscosity and a minor multifunctional amount of a reaction product prepared by reacting hydrocarbylsuccinic anhydrides or their acid equivalents with various aminoalkanols.

An object of this invention is to provide additive products having superior and/or improved multifunctional characteristics for lubricant compositions. A further object is to provide improved lubricant compositions comprising such additive products.

It is also believed that the additive reaction products disclosed herein would be useful in fuel compositions.

DESCRIPTION OF PREFERRED EMBODIMENTS

A preferred embodiment of the invention is a lubricating oil additive having unexpected antiwear and rust/corrosion inhibiting characteristics which is made by a process comprising reacting a suitable hydrocarbylsuccinic anhydride or its acid equivalent with a suitable aminoalkanol wherein the reaction is carried out at temperatures varying from ambient to about 250° C. under autogenous pressures or pressures varying from ambient to about 100 psi for a time sufficient to obtain the desired succinic acid/ester additive product of reaction and where the reaction is carried out in molar ratios of anhydride to aminoalkanol varying from about 100/99 moles to about 100/1 moles. These products are clearly hydrocarbyl carboxylic acid/esters, not oxazolines as might be affected in view of prior art.

Hydrocarbylsuccinic anhydrides in accordance with the invention have the following generalized structural formula:

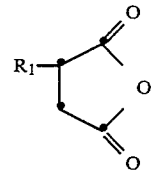

Where $R_1$ is hydrocarbyl, preferably an alkyl or alkenyl group, having 1 to 300 carbon atoms, preferably 6 to 150 carbon atoms and more preferably 6 to 30 carbon atoms.

In some applications, $R_1$ is more preferably $C_8$–$C_{18}$ hydrocarbyl.

Hydrocarbyl as used throughout the specification may also include aryl, alkaryl or aralkyl as well as alkyl or alkenyl and be cyclic or polycyclic and optionally contain O, N, S or mixtures thereof.

Some suitable aminoalkanols have the following general formula:

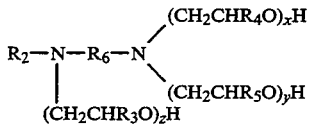

and

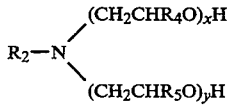

Where $R_2$ is hydrogen, or $C_1$ to $C_{100}$ hydrocarbyl. $R_2$ can also contain one or more heteroatoms such as sulfur, oxygen or nitrogen or mixtures thereof within the hydrocarbon chain, $R_3$, $R_4$ and $R_5$ are hydrogen, or $C_1$ to $C_{60}$ hydrocarbyl and $R_6$ is $C_2$–$C_{25}$ hydrocarbyl optionally may contain O, S, N or mixtures thereof, $x=0-20$, $y=0-20$, $z=0-20$ and $x+y+z$ must equal at least 1.

Any hydrocarbylsuccinic anhydride which conforms to the structural formula shown above may be used in this invention. Especially preferred are alkyl- or alkenylsuccinic anhydrides or their acid equivalents. For example, dodecenyl succinic anhydride is highly useful.

Any suitable aminoalkanol may be used. However, highly preferred are bis(2-hydroxyethyl)oleylamine, ethoxylated tallow diamine and ethoxylated fatty amine.

No solvent is necessary but if a solvent is, for some reason desired, any suitable hydrocarbon solvent such as toluene or a xylene may be used.

Conditions for the above reactions may vary widely depending upon specific reactants, the presence or absence of a solvent and the like. Any suitable set of reaction conditions known to the art may be used. Generally two to one stoichiometric quantities of reactants are used. This is essential to ensure the presence of free carboxylic group(s) in these additive reaction products for rust and corrosion inhibiting properties. Accordingly, preferred molar ratios are those that provide for a residual 1–2 carboxylate group.

However, equimolar, more than molar or less than molar amounts may be used. The reaction temperature may vary from ambient to about 250° C. or reflux, the pressure may vary from autogenous or ambient to about 100 psi and the molar ratio of anhydride to aminoalkanol preferably varies from about 100/99 moles to about 100/1 moles.

The additives embodied herein are utilized in lubricating oil or grease compositions in an amount which imparts significant antiwear characteristics to the oil or grease as well as reducing the friction of engines operating with the oil in its crankcase. Concentrations of about 0.001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorous-containing acids, liquid ureas, ferrocene derivatives, hydrogenated synthetic oils, chain-type polyphenyls, siloxanes and silicones (polysiloxanes), alkyl-substituted diphenyl ethers and phenoxy phenylethers. Fuels contemplated include liquid hydrocarbon and liquid oxygenated fuels such as alcohols and ethers. The additives can be blended in a concentration from about 0.1 to about 200 pounds of additive per 1,000 barrels of fuel. The liquid fuel can be a liquid hydrocarbon fuel or an oxygenated fuel or mixtures thereof ranging from a ratio of hydrocarbon fuel to oxygenated fuel from about 99:1 to about 1:99. Liquid hydrocarbon fuels include gasoline, fuel oils, diesel oils and alcohol fuels include methyl and ethyl alcohols and ethers such as TAME, ETBE, DIPE and MTBE.

Specifically, the fuel compositions contemplated include gasoline base stocks such as a mixture of hydrocarbons boiling in the gasoline boiling range which is within a range of about 90° F. to about 450° F. This base fuel may consist of straight chains or branched chains or paraffins, cycloparaffins, olefins, aromatic hydrocarbons, or mixtures thereof. The base fuel can be derived from among others, straight run naphtha, polymer gasoline, natural gasoline or from catalytically cracked or thermally cracked hydrocarbons and catalytically cracked reformed stock. The composition and octane level of the base fuel are not critical and any conventional motor fuel base can be employed in the practice of this invention. Further examples of fuels of this type are petroleum distillate fuels having an initial boiling point within the range of about 75° F. to about 135° F. and an end boiling point within the range of about 250° F. to about 750° F. It should be noted in this respect that the term distillate fuels is not intended to be restricted to straight-run distillate fractions. These distillate fuel oils can be straight-run distillate fuel oils catalytically (including hydrocracked) or thermally cracked distillate fuel oils etc. Moreover, such fuel oils can be treated in accordance with well-known commercial methods, such as acid or caustic treatment, dehydrogenation, solvent refining, clay treatment and the like.

Particularly contemplated among the fuel oils are Nos. 1, 2 and 3 fuel oils used in heating and as diesel fuel oils, gasoline, turbine fuels and jet combustion fuels.

The fuels may contain alcohols and/or gasoline in amounts of 0 to 50 volumes per volume of alcohol. The fuel may be an alcohol-type fuel containing little or no hydrocarbon. Typical of such fuels are methanol, ethanol and mixtures of methanol and ethanol. The fuels which may be treated with the additive include gasohols which may be formed by mixing 90 to 95 volumes of gasoline with 5–10 volumes of ethanol or methanol. A typical gasohol may contain 90 volumes of gasoline and 10 volumes of absolute ethanol.

The fuel compositions of the instant invention may additionally comprise any of the additives generally employed in fuel compositions. Thus, compositions of the instant invention may additionally contain conventional carburetor detergents, anti-knock compounds such as tetraethyl lead, anti-icing additives, upper cylinder and fuel pump lubricity additives and the like.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, nonmetallic or metallic phosphorodithioates and the like. These materials do not detract from the value of the compositions of this invention, rather the materials serve to impart their customary properties to the particular compositions in which they are incorporated.

The following examples are merely illustrative and are not meant to be limitations.

EXAMPLE 1

Approximately 213 g (0.80 mol) of dodecenylsuccinic anhydride and 141 g (0.40 mol) of bis(2-hydroxyethyl) oleylamine (Ethomeen 0/12, commercially obtained from Akzo Chemicals, Inc.) were charged to a round-bottom flask under nitrogen (an exothermic reaction), and the mixture was stirred at 80° C. for 3 hours to yield 353 g of viscous, clear, amber fluid.

EXAMPLE 2

Approximately 106.4 g (0.40 mol) of dodecenylsuccinic anhydride and 47 g (0.20 mol) of ethoxylated tallow diamine (Ethoduomeen T/13, commercially obtained from Akzo Chemicals, Inc.) were stirred at 90° C. for 4 hours under nitrogen, and additional 1½ hour at 110° C. to yield 152 g of viscous, clear, amber fluid.

EXAMPLE 3

Approximately 106.4 g (0.40 mol) of dodecenylsuccinic anhydride and 89 g (0.20 mol) of Tomah's ethoxylated fatty amine (E-14-5, commercially obtained from Tomah Products of Exxon Chemical Company) were stirred at 90° C. for 4 hours under nitrogen to yield 193 g of viscous, clear, amber fluid.

EVALUATION OF PRODUCTS

Selected products as noted below were combined with partially formulated oils and evaluated in The Rust Test ASTM (D665), The Bethlehem Steel Rust Test and in The Vickers Pump Test.

Rust Test - ASTM-665

This method involves stirring a mixture of 300 ml. of the oil under test with 30 ml. of distilled or synthetic sea water, as required, at a temperature of 140° F. (60° C.) with a cylindrical steel specimen completely immersed therein. It is customary to run the test for 24 hours; however, the test period may, at the discretion of the contracting parties, be for a shorter or longer period. Here, the test was run for 24 hours using synthetic sea water at 140° F.

Bethlehem Steel Rust Test

Rust-preventing Characteristics of Gear and Heavy Circulating Oils in the Presence of Water (adopted 1984)

This method is used to indicated the ability of gear and heavy circulating oils to aid in preventing the rusting of ferrous parts should water become mixed with the oil.

A mixture of the test oil and water containing a completely immersed cylindrical steel specimen is stirred for 24 hours at 140° F. At the end of 24 hours, the specimen is removed, examined for rust and allowed to drain. After draining, the specimen is placed into a beaker containing water at 140° F., with stirring, for 24 hours. At the end of 24 hours, the test specimen is removed from the beaker, examined for rust and returned to the beaker of water. The test is continued without stirring for 72 hours at 140° F. At the end of 72 hours, the test specimen is again examined for rust. If the oil received a rating of "severe failure" in the first part of the test, the test is discontinued.

Min. Sample Size: 350 ml

Results Reported as: Appearance of Rust on Steel Specimen

Elapsed Time: 120 Hours for Test plus 1 Hour Workup

Vickers V-104C Pump Test

Vickers V-104C vane-type pump comprises a cylindrical enclosure (the pump body) in which there is housed a so-called "pump cartridge." The "pump cartridge" assembly consists of front and rear circular, bronze bushings, a rotor, a cam-ring and rectangular vanes. The bushings and cam-ring are supported by the body of the pump and the rotor is connected to a shaft which is turned by an electric motor. A plurality of removable vanes are inserted into slots in the periphery of the rotor. The cam ring encircles the rotor and the rotor and vanes are enclosed by the cam-ring and bushings. The inner surface of the cam-ring is cam-shaped. Turning the rotor results in a change in displacement of each cavity enclosed by the rotor, the cam-ring, two adjacent vanes and the bushings. The body is ported to allow fluid to enter and leave the cavity as rotation occurs.

The Vickers Vane Pump Test procedure used herein specifically requires charging the system with 5 gallons of the test fluid and running at temperatures ranging from 100° to 135° F. at 750 to 1000 psi pump discharge pressure (load).

TABLE 1

| Item | Rust Tests ASTM Synthetic Sea Water (D665) 140° F. 24 hr | ASTM Synthetic Sea Water (D665) 140° F. 48 hr | Bethlehem Steel Rust Test Part C |
|---|---|---|---|
| Partially formulated base oil[a] | Fail | Fail | Fail (severe 55%) |
| 0.2% of Example 1 in above base oil | Pass | Pass | Pass |
| 0.2% of Example 2 in above base oil | Pass | Pass | Pass |

[a]210" SUS mixed solvent paraffinic neutral mineral oils plus antioxidant, extreme pressure/antiwear, viscosity index improver, demulsifier, and anti-foam additives.

TABLE 2

| Item | Vickers V104C Pump Test (100 hr. 1000 psi) Wear (mg) |
|---|---|
| Partially formulated base oil[b] | >1000 |
| 0.2% of Example 1 in above base oil | 8 |
| 0.2% of Example 3 in above base oil | 15 |

[b]ISO VG 46 solvent paraffinic neutral mineral oils plus antioxidant and antirust additives.

The use of additive concentrations of reaction products of the above-mentioned compositions in premium quality industrial, automotive and marine lubricants and fuels will provide multi functional antirust/anticorrosion/antiwear properties. These additives are readily prepared in a one-pot, one-step process and no solvent is necessary.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. An improved lubricant composition comprising a major proportion of an oil of lubricating viscosity or grease prepared therefrom and a minor multifunctional antiwear, rust/corrosion inhibiting proportion of an additive product of reaction prepared by reacting a hydrocarbylcarboxylic anhydride or its acid equivalent with an aminoalkanol wherein the reaction is carried out at temperatures varying from ambient to about 250° C. under autogenous pressures or pressures varying from ambient to about 100 psi for a time sufficient to obtain the desired carboxylic acid ester additive product of reaction and wherein the reaction is carried out in molar ratios of anhydride to aminoalkanol varying from about 100/99 moles to about 100/1 moles.

2. The composition of claim 1 wherein the hydrocarbylcarboxylic anhydride has the following structural formula:

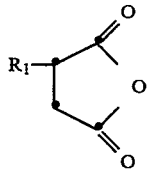

where $R_1$ is $C_1$ to about $C_{300}$ hydrocarbyl and where hydrocarbyl is selected from the group consisting of alkyl, alkenyl, aryl, alkaryl, aralkyl and may be cyclic or polycyclic and optionally contain O, N, S or mixtures thereof.

3. The composition of claim 1 wherein the aminoalkanol has the following structural formulas:

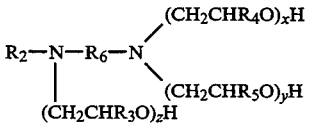

or

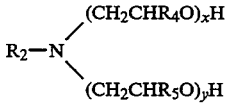

where $R_2$ is hydrogen or $C_1$ to about $C_{100}$ hydrocarbyl, $R_3$, $R_4$, and $R_5$ are hydrogen or $C_1$ to about $C_{60}$ hydrocarbyl and wherein hydrocarbyl is selected from the group consisting of alkyl, alkenyl, aryl, alkaryl or aralkyl, and $R_6$ is $C_2$ to about $C_{25}$ hydrocarbyl and may be cyclic or polycyclic and optionally contains O, S, or N or mixture thereof and where x, y and Z each equal 0 to about 20, $x+y+z$ must equal at least 1.

4. The composition of claim 1 wherein the reactants are dodecenylsuccinic anhydride and bis(2-hydroxyethyl)-oleylamine.

5. The composition of claim 1 wherein the reactants are dodecenylsuccinic anhydride and ethoxylated tallow diamine.

6. The composition of claim 1 wherein the reactants are dodecenylsuccinic anhydride and ethoxylated fatty amine.

7. The composition of claim 1 wherein the lubricant is an oil of lubricating viscosity selected from the group consisting of (1) mineral oils, (2) synthetic oils, (3) or mixtures of mineral and synthetic oils or is (4) a grease prepared from any one of (1), (2) or (3).

8. The composition of claim 1 wherein the lubricant contains from about 0.001 to about 10 wt. %, based on the total weight of the composition, of the additive product of reaction.

9. The composition of claim 8 wherein the oil of lubricating viscosity is a mineral oil.

10. A process of preparing a multifunctional antiwear, rust/corrosion inhibiting additive product of reaction comprising reacting a hydrocarbylcarboxylic anhydride or its acid equivalent with an aminoalkanol wherein the reaction is carried out at temperatures varying from ambient to about 250° C. under autogenous pressures or pressures varying from ambient to about 100 psi or for a time sufficient to obtain the desired carboxylic acid ester additive product of reaction and where the reaction is carried out in molar ratios of anhydride to aminoalkanol varying from about 100/99 moles to about 100/1 moles.

11. The process of claim 10 wherein the hydrocarbylcarboxylic anhydride has the following structural formula:

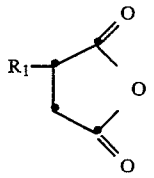

where $R_1$ is $C_1$ to about $C_{300}$ hydrocarbyl and where hydrocarbyl is selected from the group consisting of alkyl, alkenyl, aryl, alkaryl, aralkyl which may be cyclic or polycyclic and optionally contain O, N, S or mixtures thereof and where the aminoalkanol has the following structural formulas:

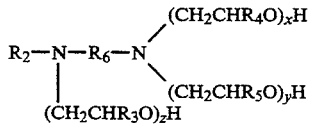

or

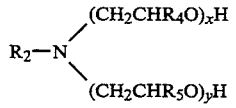

where $R_2$ is hydrogen or $C_1$ to about $C_{100}$ hydrocarbyl, $R_3$, $R_4$, and $R_5$ are hydrogen or $C_1$ to about $C_{60}$ hydrocarbyl and wherein hydrocarbyl is selected from the group consisting of alkyl, alkenyl, aryl, alkaryl or aralkyl, and $R_6$ is $C_2$ to about $C_{25}$ hydrocarbyl and may be cyclic or polycyclic and optionally contains O, S, or N or mixtures thereof and where x, y and z each equal 0 to about 20, $x+y+z$ must equal at least 1.

12. A multifunctional antiwear, rust/corrosion inhibiting lubricant additive product of reaction prepared by reacting a hydrocarbylcarboxylic anhydride or its acid equivalent with an aminoalkanol wherein the reaction is carried out at temperatures varying from ambient to about 250° C. under autogenous pressures or pressures varying from ambient to about 100 psi or for a time sufficient to obtain the carboxylic acid ester desired additive product of reaction and where the reaction is carried out in molar ratios of anhydride to aminoalkanol varying from about 100/99 moles to about 100/1 moles.

13. The additive product of reaction in accordance with claim 12 wherein the hydrocarbylcarboxylic anhydride has the following structural formula:

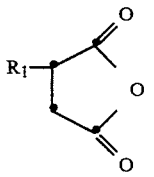

where $R_1$ is $C_1$ to about $C_{300}$ hydrocarbyl and where the aminoalkanol has the following structural formulas:

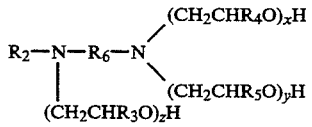

or

-continued

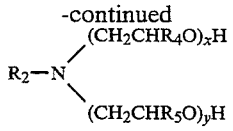

where $R_2$ is hydrogen or $C_1$ to about $C_{100}$ hydrocarbyl and where $R_3$, $R_4$, and $R_5$ are hydrogen or $C_1$ to about $C_{60}$ hydrocarbyl and $R_6$ is $C_2$ to about $C_{25}$ hydrocarbyl where hydrocarbyl is selected from the group consisting of alkyl, alkenyl, aryl, alkaryl, aralkyl which may be cyclic or polycyclic or polycyclic and optionally contain O, N, S or mixtures thereof and where x, y, and z each equal 0 to about 20, $x+y+z$ must equal at least 1.

14. A method of preparing an improved lubricant composition comprising adding to said lubricant a minor multifunctional antiwear, rust/corrosion inhibiting amount of from about 0.001 to about 10 wt. %, based on the total weight of the composition, of an additive product of reaction as claimed in claim 10.

15. The additive product of reaction in claim 12 wherein the hydrocarbylcarboxylic anhydride has the following structural formula:

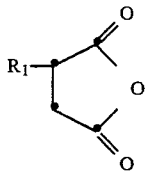

where $R_1$ is $C_1$ to about $C_{300}$ hydrocarbyl and where hydrocarbyl is selected from the group consisting of alkyl, alkenyl, aryl, alkaryl, aralkyl and may be cyclic or polycyclic and optionally contain O, N, S or mixtures thereof.

16. The composition of claim 1 wherein the hydrocarbylcarboxylic anhydride has the following structural formula:

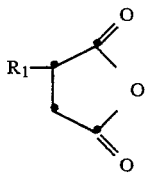

where $R_1$ is $C_{10}$ to about $C_{300}$ hydrocarbyl and where hydrocarbyl is selected from the group consisting of alkyl, alkenyl, aryl, alkaryl, aralkyl and may be cyclic or polycyclic and optionally contain O, N, S or mixtures thereof.

17. The process of claim 10 wherein the hydrocarbylycarboxylic anhydride has the following structural formula:

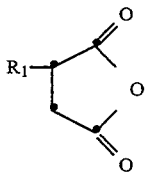

where $R_1$ is $C_{10}$ to about $C_{300}$ hydrocarbyl and where hydrocarbyl is selected from the group consisting of alkyl, alkenyl, aryl, alkaryl, aralkyl and may be cyclic or polycyclic and optionally contain O, N, S or mixtures thereof.

* * * * *